US010267094B2

(12) United States Patent
Mattson et al.

(10) Patent No.: US 10,267,094 B2
(45) Date of Patent: Apr. 23, 2019

(54) PERCUSSIVE ROCK DRILL BIT WITH OPTIMISED GAUGE BUTTONS

(71) Applicant: SANDVIK INTELLECTUAL PROPERTY AB, Sandviken (SE)

(72) Inventors: Per Mattson, Sandviken (SE); Magnus Persson, Sandviken (SE)

(73) Assignee: SANDVIK INTELLECTUAL PROPERTY, Sandviken (SE)

( * ) Notice: Subject to any disclaimer, the term of this patent is extended or adjusted under 35 U.S.C. 154(b) by 406 days.

(21) Appl. No.: 15/032,319

(22) PCT Filed: Oct. 9, 2014

(86) PCT No.: PCT/EP2014/071647
§ 371 (c)(1),
(2) Date: Apr. 27, 2016

(87) PCT Pub. No.: WO2015/062833
PCT Pub. Date: May 7, 2015

(65) Prior Publication Data

US 2016/0273275 A1 Sep. 22, 2016

(30) Foreign Application Priority Data

Oct. 28, 2013 (EP) ..... 13190404

(51) Int. Cl.
*E21B 10/56* (2006.01)
*E21B 10/36* (2006.01)
*E21B 10/38* (2006.01)

(52) U.S. Cl.
CPC ..... *E21B 10/56* (2013.01); *E21B 10/36* (2013.01); *E21B 10/38* (2013.01)

(58) Field of Classification Search
CPC ..... E21B 10/56; E21B 10/36; E21B 10/38
See application file for complete search history.

(56) References Cited

U.S. PATENT DOCUMENTS

| | | | | |
|---|---|---|---|---|
| 3,357,507 | A | 12/1967 | Stewart | |
| 3,388,756 | A | 6/1968 | Varel et al. | |
| 3,955,635 | A | 5/1976 | Skidmore | |
| 5,794,728 | A * | 8/1998 | Palmberg | E21B 10/56 175/400 |
| 2002/0153174 | A1 | 10/2002 | Linden et al. | |
| 2006/0060389 | A1 | 3/2006 | Hadin et al. | |

(Continued)

FOREIGN PATENT DOCUMENTS

| | | | |
|---|---|---|---|
| GB | 692373 | A | 6/1953 |
| RU | 2019674 | C1 | 9/1994 |
| SU | 1789645 | A1 | 1/1993 |

(Continued)

*Primary Examiner* — Wei Wang
(74) *Attorney, Agent, or Firm* — Corinne R. Gorski

(57) ABSTRACT

A percussive rock drill bit includes a plurality of peripheral gauge buttons distributed circumferentially around an axially forwardmost collar at the drill head. The gauge buttons are grouped into pairs such that the central axes of neighboring gauge buttons are aligned substantially parallel to one another and are not centered on a longitudinal axis of the bit. Enlarged flushing grooves are located at the annular collar to provide a segmented collar configuration optimized for flushing cut material rearwardly from the drill bit.

16 Claims, 5 Drawing Sheets

(56) References Cited

U.S. PATENT DOCUMENTS

2008/0087473 A1 4/2008 Hall et al.

FOREIGN PATENT DOCUMENTS

| | | | |
|---|---|---|---|
| SU | 1803517 | A1 | 3/1993 |
| WO | 2008066445 | A1 | 6/2008 |
| WO | 2009067073 | A1 | 5/2009 |
| WO | 2012174607 | A1 | 12/2012 |

* cited by examiner

PERCUSSIVE ROCK DRILL BIT WITH OPTIMISED GAUGE BUTTONS

RELATED APPLICATION DATA

This application is a § 371 National Stage Application of PCT International Application No. PCT/EP2014/071647 filed Oct. 9, 2014 claiming priority of EP Application No. 13190404.7, filed Oct. 28, 2013.

FIELD OF INVENTION

The present invention relates to a percussive rock drill bit and in particular, although not exclusively, to a drill bit formed with a cutting head mounting a plurality of peripheral gauge buttons in which neighbouring gauge buttons comprise parallel central axes to optimise the configuration of the cutting head for drilling and flushing of fractured material rearward away from the drill head.

BACKGROUND ART

Percussion drill bits are widely used both for drilling relatively shallow bores in hard rock and for creating deep boreholes. For the latter application, drill strings are typically used in which a plurality of rods are added to the string via coupling sleeves as the depth of the hole increases. A terrestrial machine is operative to transfer a combined impact and rotary drive motion to an upper end of the drill string whilst a drill bit positioned at the lower end is operative to crush the rock and form the boreholes. Fluid is typically flushed through the drill string and exits at the base of the borehole via apertures in the drill head to flush the drill cuttings from the boring region to be conveyed backward and up through the bore around the outside of the drill string. Example percussive drill bits are disclosed in U.S. Pat. No. 3,388,756; GB 692,373; RU 2019674; US 2002/0153174; U.S. Pat. No. 3,357,507, US 2008/0087473; and WO 2009/067073.

The drill bit typically comprises a drill head that mounts a plurality of hard cutting inserts, commonly referred to as buttons. Such buttons comprise a carbide based material to enhance the lifetime of the drill bit. In particular, WO 2006/033606 discloses a rock drill bit having a head with a plurality of peripheral gauge buttons distributed circumferentially at an outer perimeter of the drill head. The gauge buttons are configured to engage material to be crushed and to determine the diameter of the borehole. The head also mounts a plurality of front buttons provided at a recessed front face of the drill head for engaging material to be crushed at the axial region immediately in front the drill head. WO 2008/066445; U.S. Pat. No. 3,955,635 and WO 2012/174607 also disclose drill bits having a plurality of peripheral gauge buttons distributed circumferentially at an outer perimeter of the head with a plurality of front buttons distributed over the front face.

Typically, a plurality of flushing channels or grooves are recessed into the drill head to allow the flushing of fractured material rearwardly from the drill bit via the flushing fluid. However, convention drill heads are disadvantageous in that large pieces of material cut from the seam cannot pass through the flushing grooves without being further crushed by the bit head. This reduces the effectiveness of the cutting bit to fracture and further penetrate the rock or seam face. What is therefore required is an improved percussive drill bit that is optimised to allow relatively larger pieces of cut material to pass rearwardly from the bit head whilst maximising the cutting action.

SUMMARY OF THE INVENTION

It is an objective of the present invention to provide a percussive rock drill bit configured to aggressively break and fracture subterranean materials including in particular rock and minerals via combined impact and rotary motion. It is a further specific objective to provide a drill bit that comprises a plurality of cutting inserts (or buttons) that are arranged at the drill head to optimise the cutting action and to maximise the fragmentation of the material as it is cut to facilitate rearward flushing of the material from the bit head. It is a further specific objective to configure the drill head to allow enhanced flushing rates, in a rearward direction from the drill head, without compromising cutting performance.

The objectives are achieved by a specific alignment and distribution of the cutting buttons located at the axially forwardmost and peripheral region of the drill head, that are typically referred to as the gauge buttons. In particular, the gauge buttons of the subject invention are ordered in groups, and in particular pairs, circumferentially around the drill head and are aligned at the forwardmost perimeter region of the head such that the central axes of each button of the pair are aligned parallel to one another. That is, the central axes of the present gauge buttons are not centred on the central longitudinal axis of the drill bit but extend either side of the longitudinal axis. This is advantageous to allow the pair of gauge buttons to be positioned closer to one another which in turn creates space at the head for larger flushing grooves relative to conventional drill bits. Accordingly, further crushing of initially fractured material is unnecessary as larger pieces of fractured material are flushed readily through the enlarged flushing grooves. The present drill bit is therefore optimised for axially forward advancement.

A further advantage with grouping the peripheral gauge buttons into pairs or other tri or quad groupings, is the facility to position one or more 'front' buttons immediately radially inward of the pair of gauge buttons. Accordingly, the at least one front button and closely located pair of gauge buttons are capable of acting as a set of buttons to optimise via a cooperative crushing action to create relatively smaller material fragments without re-crushing or gridding that is undesired as it is energy inefficient.

According to a first aspect of the present invention there is provided a percussive rock drill bit comprising: a head coupled to a rearwardly projecting skirt, a longitudinal axis extending through the head and the skirt; the head having a front face surrounded by an outer collar; the collar divided into a plurality of circumferentially spaced collar segments by a plurality of grooves extending radially inward and axially from the head, the collar segments being raised and projecting axially forward of the front face, each segment having a radially outer peripheral surface that is declined relative to the axis to be radially outward facing; a plurality of gauge buttons spaced apart around the collar and projecting from the peripheral surface of each collar segment to tilt radially outward from the axis; the gauge buttons arranged in pairs at each collar segment with each button of each pair positioned side-by-side and comprising respective central axes that are parallel or nearly parallel to one another such that the central axes of the gauge buttons are not centred on the longitudinal axis; characterised by: a plurality of radially outermost front buttons, at least one of the front buttons positioned radially inward and circumferentially between the two buttons of each respective pair to form respective clusters of buttons.

Reference within this specification to 'a plurality of collar segments' encompasses discrete sections of an annular collar in a circumferential direction around the central longitudinal axis of the drill bit. In particular, reference to the collar is to be considered a reference to the collective collar segments. Parts or regions of the collar segments may be a continuous such that at least a part of the collar extends continuously through 360 degrees. Alternatively the collar is broken completely in the circumferential direction around the axis such that the collar comprises a plurality of grooves and collar segments that alternate circumferentially around the collar.

Preferably, a separation distance between the two buttons of each pair of buttons is less than a separation distance between pairs of neighbouring gauge buttons positioned at adjacent collar segments in the circumferential direction around the collar. This is advantageous to minimise the separation distance between the adjacent buttons of the pair to create space at the drill head for relatively enlarged flushing grooves that are positioned circumferentially intermediate each of the pair of gauge buttons. The flushing grooves comprise an optimised radial depth and circumferential length to facilitate flushing of large pieces of material cut from the rock or mineral as the drill bit is advanced axially.

Preferably, the central axes are aligned in respective parallel planes and are positioned parallel and to one side of a plane of the longitudinal axis. This is advantageous to allow a front button to be positioned in close proximity to a respective pair of gauge buttons to create a close-packed set of buttons that are capable of crushing cooperatively as the drill head is rotated.

Preferably, each collar segment comprises at least one inner sloping surface being inclined relative to the axis and being radially inward facing such that the front face and each sloping surface define a rearwardly projecting cavity in a forward region of the bit, the drill bit further comprising a plurality of front buttons distributed over the front face and/or inner the sloping surfaces.

Preferably, the grooves are distributed and spaced apart around the collar, each groove extending radially inward from the peripheral surface and extending axially from the head and along at least a part of the skirt to divide the collar into the collar segments. This configuration greatly facilitates the axially rearward transfer of the flushed material from the cutting head. Preferably, each groove comprises a V-shaped profile in a plane aligned perpendicular to the longitudinal axis. The radially outermost part of each groove is therefore wider than a radially innermost part to facilitate flushing of debris materials. According to the preferred embodiment, a radial length of each groove is not less than or more than half a radial distance between the central axis and a radially outermost part of the peripheral surface. This is advantageous to expel debris matter form the bit head and avoid accumulation of cut debris material at the recessed cavity that may hinder axial advancement of the bit.

Preferably, a maximum length of each groove in a circumferential direction between respective sidewalls that define each groove and each segment is in the range 50 to 75% of a maximum length of each segment in a circumferential direction between the sidewalls. More preferably, this range is 60 to 70% and may be approximately 65%.

Preferably, each collar segment comprises a channel extending axially rearward from each respective segment and along at least a part of the skirt to at least partially partition each segment in a circumferential direction wherein at least one gauge button is positioned either side of each respective channel within a segment. The combination of the grooves and the radially shorter channels is advantageous to facilitate debris flushing and optimise the crushing effectiveness of the 'grouped' gauge buttons and front buttons. Specifically, crushed material is capable of exiting the recessed cavity defined by the peripheral collar through the channels that are positioned between the adjacent gauge buttons. Larger pieces of crushed material are accordingly forced through the larger grooves and the combined action provides a drill bit optimised for crushing and flushing of material contacted by the bit.

Preferably, one of the front buttons is positioned radially inward of the side-by-side neighbouring gauge buttons and in between each of the neighbouring gauge buttons at a region radially inside the channel to define a set of buttons such that a separation distance between each button of the set of buttons is substantially equal.

Optionally, a diameter of each button of the set of buttons is substantially equal. This is advantageous to optimise the cooperative crushing of the gauge and front buttons and to allow the desired flow of crushed material to exit the drill head via the channels and the grooves.

Preferably, the drill bit further comprises a plurality of inner front buttons positioned radially inside the front button included within each of the set of buttons, the inner front buttons having a diameter less than the front button of each set of buttons.

Preferably, a radial depth of each channel is less than a radial depth of each groove. Preferably, the peripheral surface in each half of each respective segment either side of the channel is angled to be sloping inwardly towards the channel.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
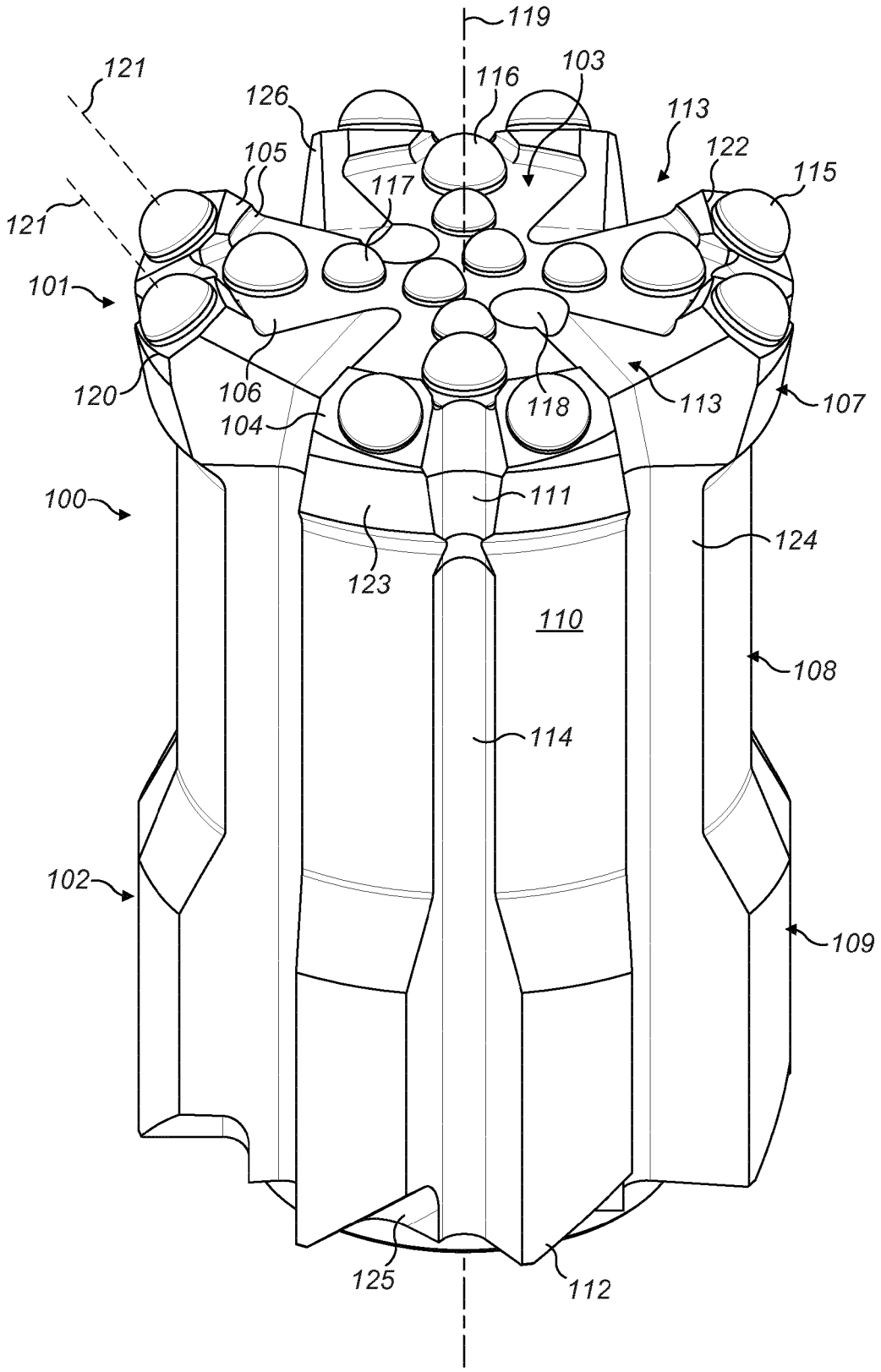
FIG. 1 is an upper perspective view of the percussive rock drill bit having a skirt and a drill head mounting a plurality of cutting inserts (buttons) according to a specific implementation of the present invention.

Referring to FIGS. 1 to 5 a drill bit 100 comprises a drill head 101 formed at one end of a generally elongate shaft 108. An opposite end of shaft 108 is flared radially outward to provide an annular flange 109. Shaft 108 and flange 109 collectively define a skirt 102 that represents a trailing region of drill bit 100 as it is advanced through the rock or subterranean material via the leading drill head 101. A plurality of axially extending skirt channels 114 are recessed into the outer surface of skirt 102 and extends almost the entire axial length of drill bit 100. Skirt channels 114 extend to head region 101 to create depressions or short head channels 111 extending radially inward towards a central longitudinal axis 119 (extending through drill bit 100) from a radially outermost peripheral edge 120 of head 101. The circumferentially spaced apart head channels 111 define intermediate axially extending ridges 110 that also extend over the substantially entire axial length of drill bit 100.

A plurality of cutting teeth 112 are provided at an axially rearward region of skirt 102 and in particular annular flange 109. Teeth 112 comprise an axially rearward facing cutting surface 125 configured to facilitate extraction of the drill bit 100 backwards through the borehole created by the advancing head 101. Teeth 112 are formed at the end regions of each ridge 110.

Head 101 is flared radially outward relative to shaft 108 and comprises an outer diameter being approximately equal to an outside diameter of flange 109 to form a raised outer collar represented generally by reference 107. Collar 107 forms a perimeter of a cavity 103 that projects axially rearward from a forwardmost annular rim 122 of collar 107. Cavity 103 is also defined, in part, by a plurality of sloping side surfaces 105 that are angled upward from axis 119. The inclined side surfaces 105 are terminated at respective forwardmost ends by a broken annular rim 122 and at respective rearward ends by a front facing surface 106. Front surface 106 is aligned substantially perpendicular to axis 119 and is generally planar.

Collar 107 is further defined, in part, by a peripheral surface 104 that extends circumferentially and radially outward beyond rim 122. Peripheral surface 104 is terminated by radially outermost edge 120 and is angled radially downward from axis 119 so as to be radially outward facing whilst cavity side surfaces 105 are orientated to be generally inward facing towards axis 119. A head trailing surface 123 extends axially rearward of peripheral surface 104 and is also orientated transverse to axis 119 so as to decrease the diameter of collar 107 towards a diameter of shaft 108. According to the shape profile and configuration of head 101 and in particular the peripheral raised collar 107, cavity region 103 comprises a generally bowl or dish-shaped configuration in which the sides of the bowl are defined by sloping surfaces 105 and the base of the bowl is defined by front surface 106. Two pairs of diametrically opposed grooves 113 are formed within collar 107, each groove 113 extending axially downward forwardmost rim 122 and radially inward from peripheral outer edge 120 to break or interrupt collar 107 which is discontinuous in the circumferential direction around axis 119, such that collar 107 is formed by short circumferentially extending segments. Each groove 113 comprises a generally V-shaped configuration in which a width of the groove at its radially innermost region (corresponding to front face 106) is smaller than a corresponding width at a radially outer region (corresponding to rim 122). Each groove 113 extends axially rearward from head 101 creating elongate skirt grooves 124 recessed into shaft 108 and terminating at the axially rearward end of bit 100 at teeth 112. Grooves 113, 124 and channels 111, 114 allow debris material to pass radially outward from cavity 103 and subsequently axially rearward of head 101.

Drill head 101 comprises three types of hardened cutting inserts (referred to herein as buttons). A first set of buttons 115 are positioned at peripheral surface 104 and are configured as gauge buttons to determine and maintain a predetermined diameter of the borehole formation. Gauge buttons 115 are tilted radially outward so as to be generally inclined and outward facing from axis 119 consistent with peripheral surface 104. Gauge buttons 115 are embedded within and distributed circumferentially around the perimeter region of collar 107 (collar segments) to project axially forward of rim 122 and to represent collectively an axially forwardmost cutting edge of drill bit 100. Additionally, each gauge button 115 comprises a region that extends radially outward beyond the outermost edge 120 of collar 107 so as to define a radially outer cutting edge of the bit 100. A second set of buttons 117 are embedded in front facing surface 106 at a radially inner region of cavity 103. Inner front buttons 117 are aligned generally with axis 119. A third set of buttons 116 are provided at a radially outer region of front surface 106 just inside collar 107. Outer front buttons 116 are also aligned generally with axis 119. The radially outer front buttons 116 are enlarged relative to the radially inner front buttons 117 and comprise a diameter being substantially equal to a diameter of the gauge buttons 115.

A plurality of flushing holes 118 extends axially rearward from front face 106 and are coupled to an internal fluid delivery conduit to allow a flushing fluid to be dispensed at head 101 and to expel crushed material radially outward from cavity 103 via grooves 113 and channels 111. The fractured material and fines are then flushed axially rearward from head 101 and along the axial grooves and channels 124, 114. According to the specific implementation, head 101 comprises two diametrically opposed flushing holes 118 each positioned at the radially innermost region of two respective grooves 113. The four head grooves 113 are spaced apart in a circumferential direction around axis 119 so as to divide collar 107 into four collar segments. Each segment is at least partially divided at its radially outermost region by a respective channel 111. Each collar segment comprises a pair of gauge buttons 115, with each of the pair of buttons 115 separated in a circumferential direction by channel 111. Accordingly, each pair of gauge buttons 115 is separated in a circumferential direction from a neighbouring pair of gauge buttons 115 by each respective groove 113. Each groove 113 and each collar segment is defined by groove sidewalls 126 that extend radially inward from the head outermost edge 120 towards axis 119.

Each gauge button 115 is generally bullet shaped and embedded at head 101 such that a forwardmost rounded end projects from the collar segment. Each gauge button 115 also comprises a central axis that is sloping or tilted away from axis 119. In particular, each of the pair of gauge buttons 115 comprises central axes 121 that are aligned parallel with one another. The axes 121 of the pair of neighbouring buttons 115 are therefore not centred at longitudinal axis 119 and extend either side of axis 119.

Figure 2:
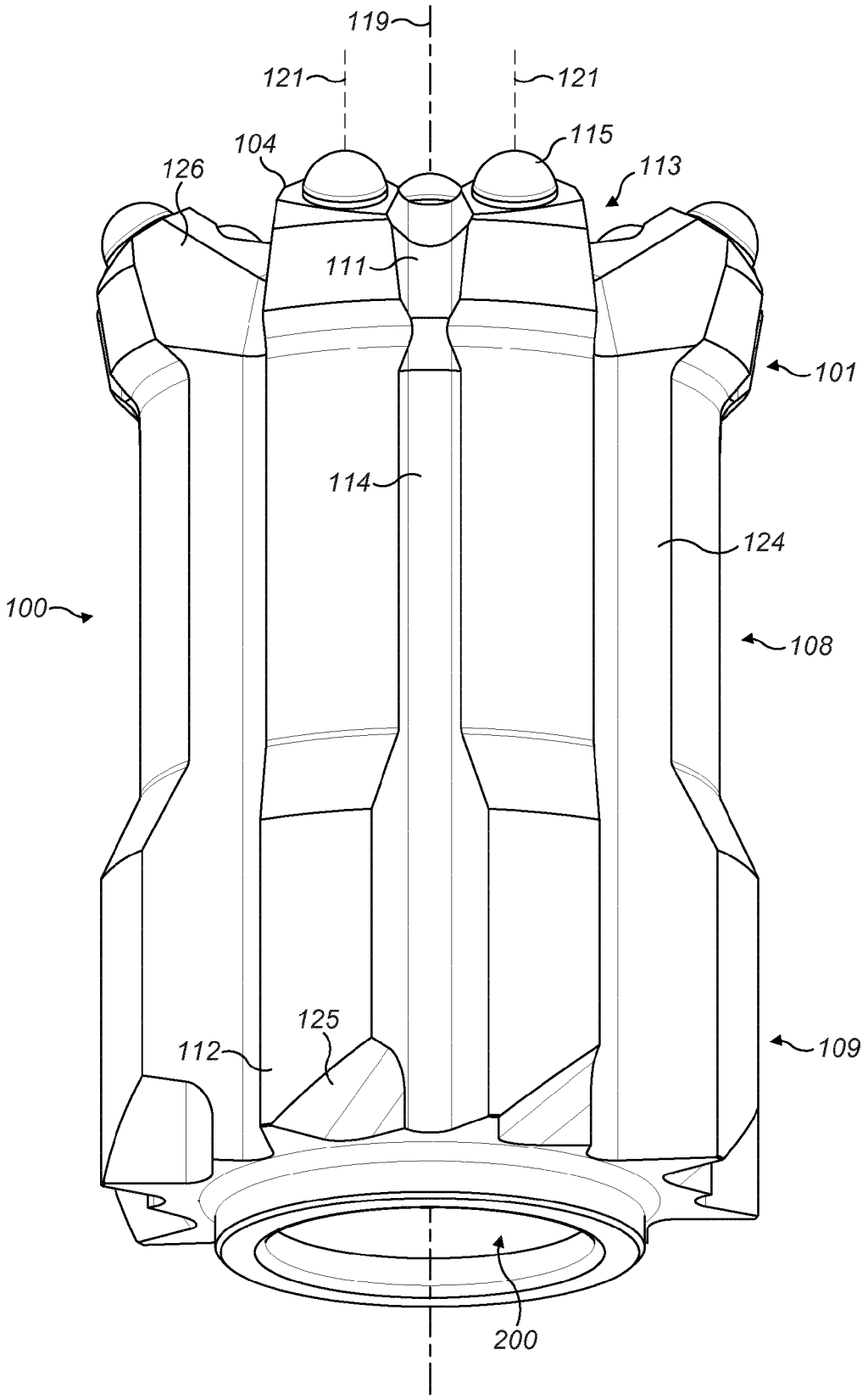
FIG. 2 is a lower perspective view of the drill bit of FIG. 1.

Referring to FIG. 2, drill bit 100 comprises an internal axially extending bore 200 formed within shaft 108 and terminated internally within head 101 by one or more conduits (not shown) that emerge at front surface 106 as flushing holes 118. Accordingly, flushing fluid may be introduced through the bit 100 via bore 200.

Figure 3:
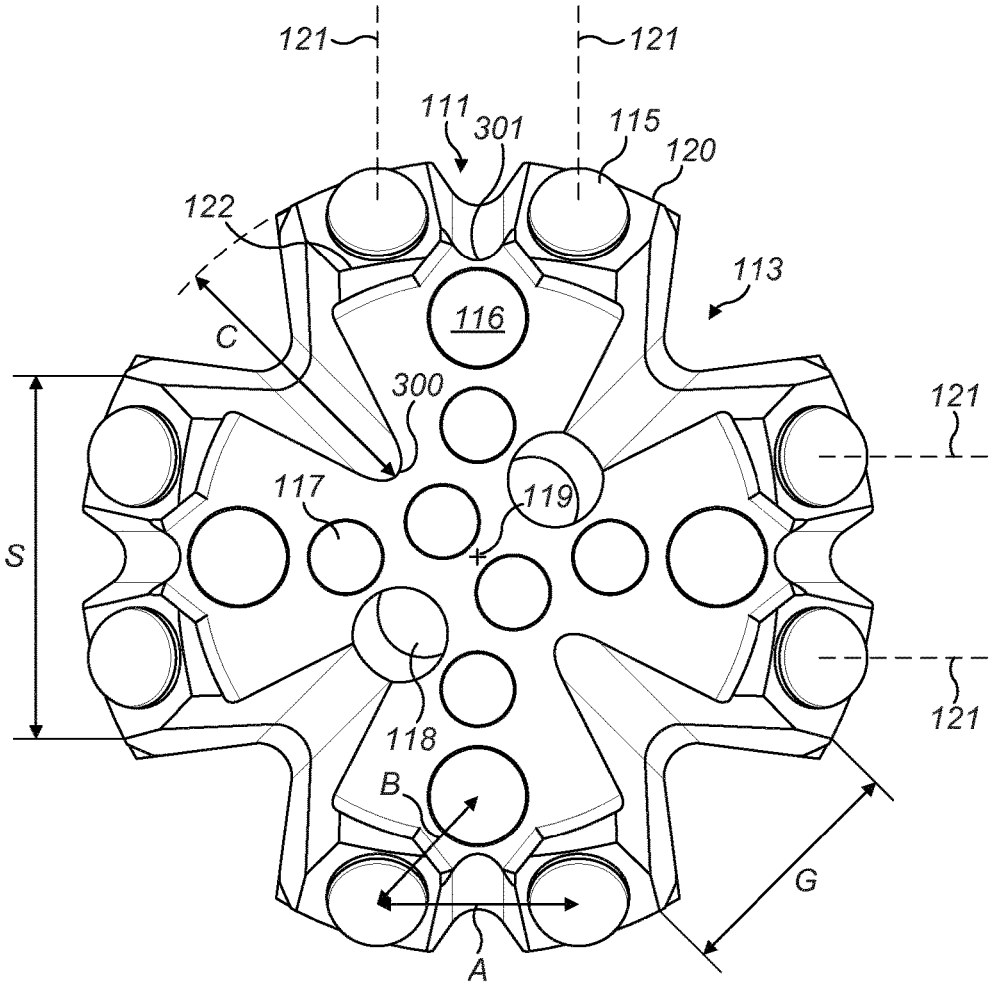
FIG. 3 is a plan view of the head region of the drill bit of FIG. 2.
Figure 4:
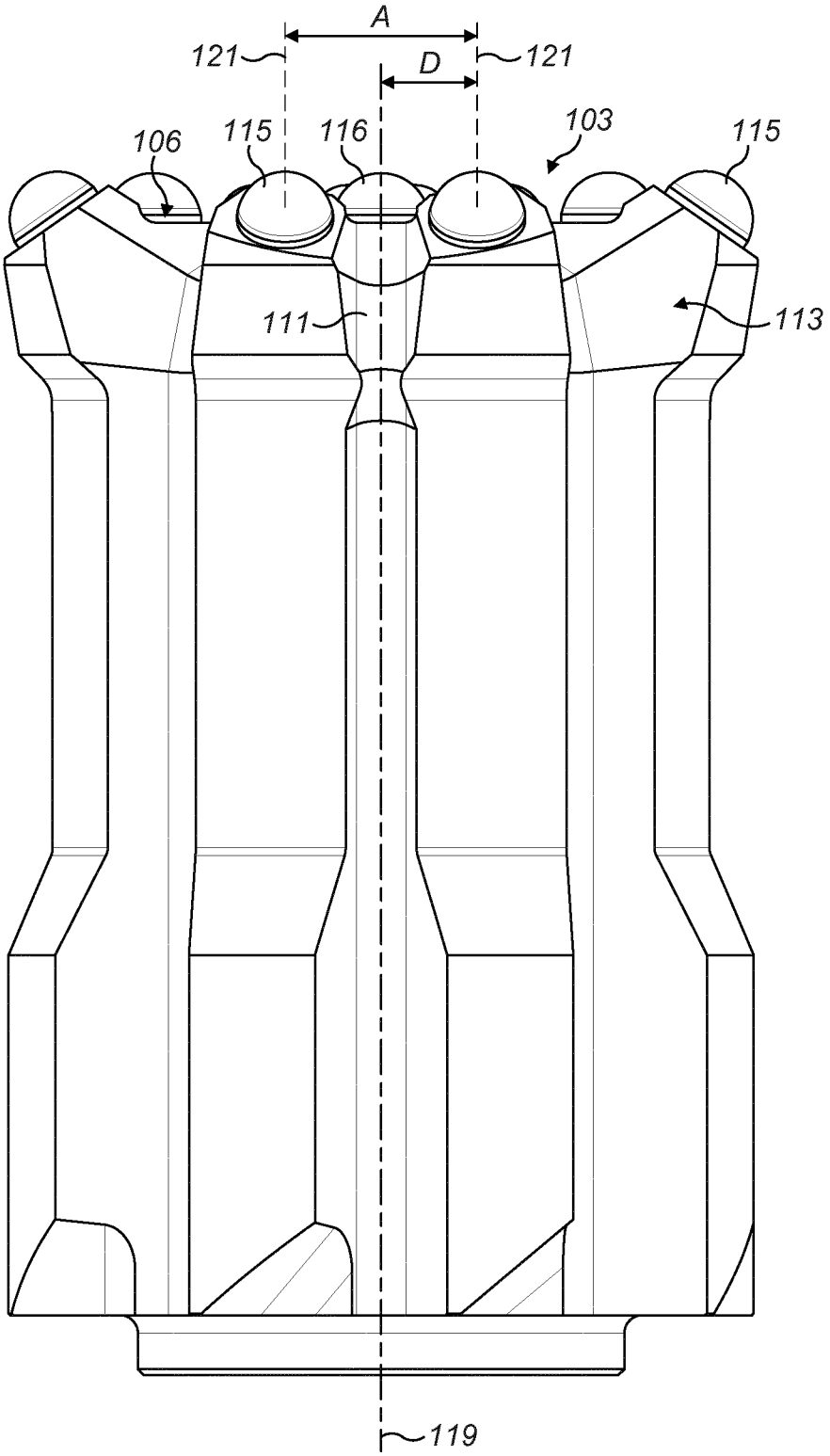
FIG. 4 is an external side elevation view of the drill bit of FIG. 2.
Figure 5:
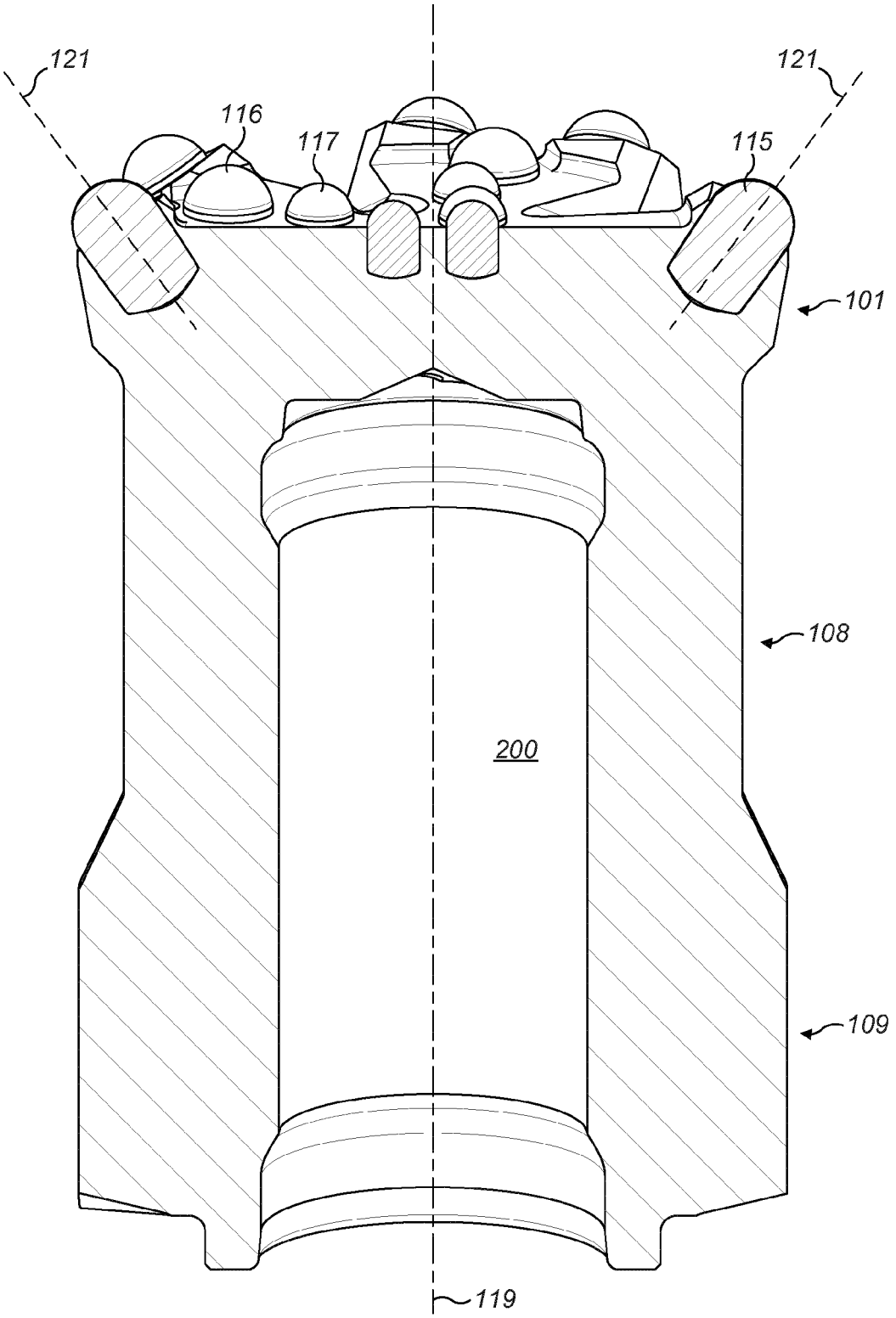
FIG. 5 is a cross sectional side view through the centre of the drill bit of FIG. 4.

Referring to FIGS. 3 to 5, drill bit 100 comprises four sets of pairs of gauge buttons 115, with each pair provided at four respective collar segments separated circumferentially from one another by the radially projecting grooves 113. Each collar segment may therefore be considered to form a radially extending arm in which the pair of gauge buttons 115 represents a radially outermost and axially forwardmost region of the arm. As illustrated in FIG. 3, each groove 113 extends radially inward from the peripheral edge 120 towards central axis 119 according to a V-shaped profile (in the plane perpendicular to axis 119). A radial depth C of each groove 113 is defined as the radial distance between peripheral edge 120 and a radially innermost end 300 of groove 113 that terminates at front surface 106 and adjacent axis 119. According to the specific implementation, the radial distance C is more than half the radial distance between axis 119 and annular rim 122 that represents the radially innermost region of peripheral surface 104. In particular, and according to the specific implementation, radial length C is approximately 65 to 75% the radial distance between axis 119 and rim 122.

A width of each groove 113 in a circumferential direction is indicated by reference G representing the maximum separation distance in a circumferential direction between the pair of groove sidewalls 126. The length of each collar segment in a circumferential direction is illustrated generally by reference S representing the distance across the collar segment (and the gauge buttons 115) between respective sidewalls 126 of neighbouring grooves 113. According to the specific implementation, length G is 60 to 70% of length S. As indicated, the relatively large circumferential length G and radial length C of each groove 113 is advantageous to facilitate flushing of larger fragments of material that optimises drilling performance for axially forward advancement of the drill bit without a requirement for secondary crushing of the large fragment pieces prior to flushing as is common with conventional drill bits.

FIG. 3 illustrates the arrangement of each pair of gauge buttons 115 with a respective radially outermost front button 116 to form a triad arrangement. As indicated, the parallel central axes alignment of the gauge buttons 115 allows a close positioning of front button 116 circumferentially intermediate each of the pair of gauge buttons 115 to create a close-packed cluster of buttons (two gauge and one front) to optimise crushing effectiveness as the drill bit is advanced axially forward. Additionally, a separation distance A between the axial centres 121 of the pair of gauge buttons 115 is substantially equal to the separation distance B between each gauge buttons 115 (of the pair) and the associated radially outer front button 116. As detailed in FIG. 4, when viewed from the side, the lateral separation distance B between the axial centres 121 of the gauge buttons 115 and the front button 116 is half of distance A such that front button 116 is positioned at the mid-point between the pair of gauge buttons 115.

Also referring to FIG. 3, and according to the specific implementation, a radial depth of each channel 111 from the peripheral edge 120 to a radially innermost end 301 is approximately equal to or slightly greater than the radial length of the peripheral surface 104 as defined between peripheral edge 120 and annular rim 122. Additionally, the radially innermost end 300 of each groove 113 is positioned radially inside the front buttons 116 and at the approximate radial position of each flushing hole 118 relative to axis 119.

According to the specific implementation, the pairs of gauge buttons 115 are arranged circumferentially around collar 107 such that a first set of two pairs of the gauge buttons 115 are positioned diametrically opposite and a second set of two pairs of gauge buttons 115 are positioned diametrically opposite. Accordingly, the central axes 121 of the four gauge buttons 115 of the first set are aligned on two common planes and similarly the central axes 121 of the four gauge buttons 115 of the second set are aligned on two common planes with each of the four planes extending to the side of axis 119.

The invention claimed is:

1. A percussive rock drill bit comprising:

a head coupled to a rearwardly projecting skirt, a longitudinal axis extending through the head and the skirt, the head having a front face surrounded by an outer collar, the collar being divided into a plurality of circumferentially spaced collar segments by a plurality of grooves extending radially inward and axially from the head, the collar segments being raised from and projecting axially forward of the front face, each collar segment having a radially outer peripheral surface that is declined relative to the axis to be radially outward facing;

a plurality of gauge buttons spaced apart around the collar and projecting from the peripheral surface of the each collar segment to tilt radially outward from the axis, the plurality of gauge buttons being arranged in pairs at the each collar segment with each button of each pair positioned side-by-side and having respective central axes that are parallel or nearly parallel to one another such that the central axes of the gauge buttons are not centered on the longitudinal axis; and a plurality of radially outermost front buttons, at least one of the plurality of front buttons being positioned immediately radially inward and circumferentially between two gauge buttons of each respective pair to form respective clusters of buttons.

2. The drill bit as claimed in claim 1, wherein a separation distance between the two gauge buttons of each pair of gauge buttons is less than a separation distance between pairs of neighbouring gauge buttons positioned at adjacent collar segments in the circumferential direction around the collar.

3. The drill bit as claimed in claim 2, wherein the central axes are aligned in respective parallel planes and are positioned parallel and to one side of a plane of the longitudinal axis.

4. The drill bit as claimed in claim 3, wherein each collar segment includes at least one inner sloping surface being inclined relative to the axis and being radially inward facing such that the front face and each sloping surface define a rearwardly projecting cavity in a forward region of the bit.

5. The drill bit as claimed in claim 4, further comprising a plurality of front buttons distributed over the front face and/or the at least one inner sloping surface.

6. The drill bit as claimed in claim 5, wherein the plurality of front buttons included within each cluster of buttons have a diameter being equal to or nearly equal to a diameter of the plurality of gauge buttons.

7. The drill bit as claimed in claim 6, wherein each of the plurality of grooves has a V-shaped profile in a plane aligned perpendicular to the longitudinal axis.

8. The drill bit as claimed in claim 7, wherein a radial length of each groove is greater than half of a radial distance between the central axis and a radially outermost part of the peripheral surface.

9. The drill bit as claimed in claim 6, wherein a maximum length of each of the plurality of grooves in a circumferential direction between respective sidewalls that define each of the plurality of grooves and each segment is in the range 50 to 75% of a maximum length of the each collar segment in a circumferential direction between the sidewalls.

10. The drill bit as claimed in claim 1, further comprising a single radially outermost front button positioned immediately radially inward and circumferentially between the two gauge buttons of each respective pair of gauge buttons to form a respective triad clusters of buttons.

11. The drill bit as claimed in claim 10, wherein the each collar segment includes a channel extending axially rearward from each respective collar segment and along at least a part of the skirt to at least partially partition the each collar segment in a circumferential direction, wherein at least one gauge button is positioned at either side of each respective channel within the each collar segment.

12. The drill bit as claimed in claim 11, wherein a separation distance between the buttons of the triad cluster of buttons is equal or nearly equal.

13. The drill bit as claimed in claim 12, wherein a diameter of each button of the triad cluster of buttons is equal or nearly equal.

14. The drill bit as claimed in claim 13, further comprising a plurality of inner front buttons positioned radially inside each of a plurality of outer front buttons included within the triad cluster of buttons, the inner front buttons having a diameter less than the outer front buttons of the triad cluster of buttons.

15. The drill bit as claimed in claim 11, wherein a radial depth of each channel is less than a radial depth of each groove.

16. The drill bit as claimed in claim 11, wherein the peripheral surface in each half of the each respective collar segment at either side of the channel is angled to be sloping inwardly towards the channel.

* * * * *